US009714791B2

(12) United States Patent
Krieg et al.

(10) Patent No.: US 9,714,791 B2
(45) Date of Patent: Jul. 25, 2017

(54) METHOD FOR OPERATING AN ANODE FURNACE AND CONTROL DEVICE

(75) Inventors: Peter Krieg, Weimar (DE); Hans-Jörg Seifert, Jena (DE); Andreas Himmelreich, Golmsdorf (DE); Frank Heinke, Weimar (DE); Detlef Maiwald, Moers (DE)

(73) Assignee: INNOVATHERM PROF. DR. LEISENBERG GMBH + CO. KG, Butzbach (DE)

( * ) Notice: Subject to any disclaimer, the term of this patent is extended or adjusted under 35 U.S.C. 154(b) by 199 days.

(21) Appl. No.: 14/373,406

(22) PCT Filed: Jan. 25, 2012

(86) PCT No.: PCT/EP2012/051141

§ 371 (c)(1),
(2), (4) Date: Aug. 8, 2014

(87) PCT Pub. No.: WO2013/110330

PCT Pub. Date: Aug. 1, 2013

(65) Prior Publication Data

US 2015/0159953 A1 Jun. 11, 2015

(51) Int. Cl.

| | |
|---|---|
| ***F27B 13/14*** | (2006.01) |
| ***F27D 21/04*** | (2006.01) |
| ***F27D 19/00*** | (2006.01) |

(52) U.S. Cl.

CPC ..... *F27B 13/14* (2013.01); *F27D 19/00* (2013.01); *F27D 21/04* (2013.01)

(58) Field of Classification Search

CPC ..... F27B 13/14; F27D 19/00; F27D 21/04

USPC ..... 266/44, 78; 432/32, 1, 36, 37, 52, 192

See application file for complete search history.

(56) References Cited

U.S. PATENT DOCUMENTS

| | | | | |
|---|---|---|---|---|
| 4,284,404 | A * | 8/1981 | Genevois | F27B 13/00 432/192 |
| 4,744,749 | A | 5/1988 | Dreyer | |
| 8,594,417 | B2 * | 11/2013 | Gagne | C25C 3/06 205/80 |
| 2007/0065766 | A1 * | 3/2007 | Mnikoleiski | F27D 21/0021 431/2 |

(Continued)

FOREIGN PATENT DOCUMENTS

| | | | |
|---|---|---|---|
| EP | 0019425 | A1 | 11/1980 |
| EP | 1742003 | A1 | 1/2007 |

(Continued)

*Primary Examiner* — Scott Kastler
*Assistant Examiner* — Michael Aboagye
(74) *Attorney, Agent, or Firm* — King & Schickli, PLLC

(57) ABSTRACT

A method and to a control device 10 for operating an anode furnace including an extraction ramp arranged in a section of a heat-up zone and a burner ramp arranged in a section of a firing zone of the furnace unit, wherein operation of ramps is controlled by means of a control device of the furnace unit, wherein the ramps each have a read unit, wherein the section each have at least one stationary transponder unit, wherein the read units of the ramps communicate with the transponder units of the sections in which the ramps are arranged, wherein the respective transponder units are identified by means of the control device, and wherein a respective position of the ramps is determined by allocating the ramps to the respective transponder units.

17 Claims, 3 Drawing Sheets

(56) References Cited

U.S. PATENT DOCUMENTS

Figure 1:
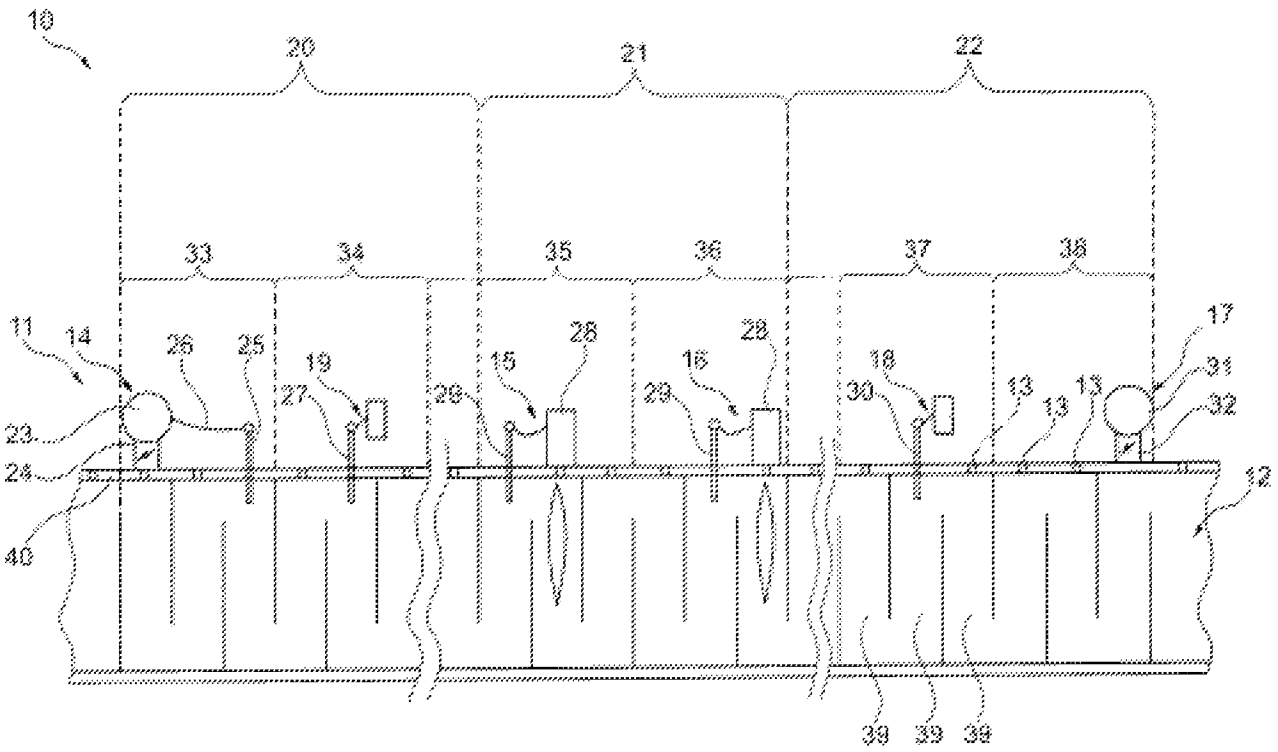

2011/0146447 A1* 6/2011 Reichel ..... C21C 5/5264
75/10.12

FOREIGN PATENT DOCUMENTS

| | | | |
|---|---|---|---|
| EP | 1785685 | A1 | 5/2007 |
| FR | 2918164 | A1 | 1/2009 |

* cited by examiner

METHOD FOR OPERATING AN ANODE FURNACE AND CONTROL DEVICE

FIELD OF THE INVENTION

The invention relates to a method for operating an anode furnace as well as to a control apparatus, wherein the anode furnace is formed from a plurality of heating ducts and furnace chambers, wherein the furnace chambers serve for receiving anodes and the heating ducts serve for controlling the temperature of the furnace chambers, wherein the anode furnace comprises at least one furnace unit, wherein the furnace unit comprises a heating zone, a firing zone and a cooling zone, which are in turn formed from at least one section comprising furnace chambers, wherein a suction ramp is arranged in a section of the heating zone and a burner ramp is arranged in a section of the firing zone of the furnace unit, wherein operation of the ramps is controlled by means of a control apparatus of the furnace unit.

BACKGROUND OF THE INVENTION

The present method and the apparatus, respectively, are applied in the production of anodes that are required for fused-salt electrolysis for the production of primary aluminum. These anodes are produced in a molding procedure as so-called "green anodes" or "raw anodes", from petroleum coke, to which pitch is added as a binding agent, the anodes being sintered in an anode furnace subsequently to the molding procedure.

This sintering process is realized in a heat treatment process which takes place in a defined manner, and during which the anodes pass through three phases, namely a heating phase, a sintering phase and a cooling-down phase. In this case, the raw anodes are situated in a heating zone of a "fire" that is composed of the heating zone, a firing zone and a cooling zone and that is formed in the anode furnace, the raw anodes being pre-heated by the waste heat of already fully sintered anodes that originates from the firing zone, prior to the pre-heated anodes being heated to the sintering temperature of approximately 1200° C. in the firing zone. According to the state of the art as it is known, for example, from the document EP 1 785 685 A1, the different designated zones are defined by an alternately continuous arrangement of different modules above furnace chambers or heating ducts that receive the anodes.

The firing zone, which is arranged between the heating zone and the cooling zone, is defined by positioning a burner device or a so-called burner ramp above selected furnace chambers or heating ducts. Anodes that have been burned directly prior thereto, which means that have been heated to the sintering temperature, are situated in the cooling zone. Above the cooling zone, a blower device or a so-called cooling ramp is arranged, by means of which air is blown into the heating ducts of the cooling zone. By means of a suction device that is arranged above the heating zone or by means of a so-called suction ramp, the air is guided, via the heating ducts, from the cooling zone through the firing zone into the heating zone, and, from the latter, in the form of flue gas, guided through a flue gas cleaning system, being released into the surroundings. The suction device and the burner device form a furnace unit together with the cooling ramp and the heating ducts.

The above-described modules are displaced at regular time intervals along the heating ducts in the direction of the raw anodes that are arranged in the anode furnace. In this way, there can be provision for an anode furnace comprising several furnace units, the modules of which are displaced, subsequently to one another, above the furnace chambers or heating ducts for subsequent heat treatments of the raw anodes or anodes. In case of such anode furnaces, which can be embodied as open anode furnaces or annular anode furnaces in different designs, a number of further ramps, such as a measuring ramp, a pressure ramp as well as several additional cooling and burner ramps, is regularly used and functionally assembled in addition to the above-described modules or ramps. The individual different types of ramps have to be placed in a certain order and at a certain distance to one another so that they can be operated as one furnace unit in the desired manner. The ramps are displaced by operating personnel, manually or using a crane, at cyclical time intervals of, for example, 24 to 26 hours. For that purpose, operation of the furnace unit is interrupted and started again after the ramps have been re-positioned. In particular when the operating personnel shifts the ramps, it may happen that the ramps are faultily positioned relative to one another or that the different types of ramps are mounted in a faulty order. This can lead to procedural functional disorders and to dangerous operating statuses of the anode furnace with the risk of deflagrations, fires or explosions.

It is, for example, known to pass information on the respective positions of the ramps on through manual input into a control device of the furnace unit, for example a PLC installation. Thus, the ramp mounting is at least visually inspected. The operating personnel can, however, also make a mistake when readjusting the ramp position or when manually inputting said information. Therefore, it is still possible to start the furnace unit even though a ramp is mounted in a faulty position.

SUMMARY OF THE INVENTION

Therefore, the present invention is based on the task to propose a method and a control apparatus for operating an anode furnace, with which method or apparatus a possibly faulty mounting of a ramp can definitely be prevented.

In the method in accordance with the invention for operating an anode furnace, the anode furnace is formed from a plurality of heating ducts and furnace chambers, wherein the furnace chambers serve for receiving anodes and the heating ducts serve for controlling the temperature of the furnace chambers, wherein the anode furnace comprises at least one furnace unit, wherein the furnace unit comprises a heating zone, a firing zone and a cooling zone, which are in turn formed from at least one section comprising furnace chambers, wherein a suction ramp is arranged in a section of the heating zone and a burner ramp of the furnace unit is arranged in a section of the firing zone, wherein operation of the ramps is controlled by means of a control apparatus of the furnace unit, wherein the ramps include one reading unit each, wherein the sections include at least one stationary transponder unit each, wherein the reading units of the ramps communicate with the transponder units of the sections in which the ramps are arranged, wherein the respective transponder units are identified by means of the control apparatus, and wherein a respective position of the ramps is determined by allocating the ramps to the respective transponder units.

Accordingly, the furnace chambers form sections which are each composed of one or more furnace chambers. In every section, at least one transponder unit is stationarily arranged. Furthermore, one reading unit each is fitted to at least one ramp, preferably to all the ramps of the furnace unit, which reading unit, when the ramp is mounted in an arbitrary section, is made to locally overlap with the transponder unit of the section or is brought close to the transponder unit in such a manner that the reading unit can communicate with the transponder unit. Always when the furnace unit is trammed, the transponder units of those sections in which ramps have been mounted are now initially identified by means of the control apparatus. Since the transponder units are individualized in each case, i.e. they cannot be confused, it is possible to allocate the ramps to the respective transponder units. Here, it is assumed that a position or allocation of the transponder units to the respective sections is stored in the control apparatus. In this way, the control apparatus can now establish which ramp was mounted in which section and can thus determine the respective position of the ramps. In this way, the control apparatus can easily detect a faulty mounting or positioning of a ramp.

It is particularly advantageous if a control unit of the control apparatus activates the reading units of the ramps after the furnace unit has been displaced, wherein the reading units can read out information stored by the transponder units which are allocated to the ramps. The control unit can in particular be a PLC installation of the furnace unit. A PLC installation which is in any case present can then, for example, be expanded in such a manner that the reading units, amongst others, are initially activated at first when the PLC installation or the furnace unit is started. In this way, already in the context of every putting into operation of the furnace unit or during operation of the anode furnace, the information stored in the transponder units can be read out and processed by the PLC installation.

The information which is stored in the transponder units and is read out can be displayed by the control unit for inspection. Thus, it is possible for operating personnel to inspect the correct mounting of the ramps directly at the control unit or else at a spatially remote control station by examining the displayed information before the putting into operation can be continued through a release by the operating personnel. In particular, the operating personnel can compare the displayed information on the position of the ramps to the actual position of the ramps. Furthermore, it is possible for the operating personnel to correct potentially faulty information of the transponder units, if any. Consequently, the operating personnel can correct or replace transponder units which might be faultily programmed or defective transponder units and can re-position ramps which are faultily mounted, continuing to put into operation in the following.

Irrespective of the function of the control unit of displaying the information, the control unit can also take over the inspecting function of the operating personnel. If the information is inspected by the control unit, a plausibility check of position-independent information can then be effected through the control unit. The control unit can accordingly be embodied in such a manner that the information which is read out by the transponder units are initially checked in respect of their plausibility. In this way, defective transponder units or those which are faultily programmed can easily be recognized by the control unit. Here, the control unit can also interrupt a process of putting into operation automatically.

The information can also be corrected by the control unit. For example, the control unit can comprise a database having frequent errors and possible configurations of a furnace unit. Then, the control unit can autonomously or automatically correct information which has been recognized to be faulty.

When the information is inspected by the control unit, a plausibility check of position-dependent information can also be effected, wherein a presupposed position of the ramps can be compared to an actual position of the ramps. In addition to inspecting position-independent errors, to be precise errors which do not directly relate to a faulty mounting of the ramps, the actual position or mounting of the ramps can consequently also be inspected. This can, again, be effected by a comparison of the information which is read out from the transponder units to presupposed information for a configuration of the furnace unit which is stored in the control unit.

In this way, there can furthermore be provision for the ramps being put into operation only after successfully having checked the position of the ramps. Then, function of the ramps cannot be initiated before the control apparatus has released this final method step belonging to the putting into operation. In this way, it is ensured that all ramps are situated in the desired position.

The transponder unit itself can store a numerical designation of the section of the transponder unit, a numerical designation of the anode furnace of the transponder unit and a total number of the sections of the anode furnace of the transponder unit. In this way, even in an operating system having several anode furnaces, every transponder unit can absolutely certainly be distinguished from other transponder units and can be allocated to a defined position in the respective anode furnace. The above-described information can also be used alone for a plausibility check of the transponder unit. It is furthermore possible that the transponder unit stores still other information, such as an identification number.

In order to adapt an anode furnace to requirements which might have changed, it is advantageous if the transponder unit can be programmed by a further reading instrument, which is portable. In this way, the transponder units which are assigned to sections in each case can individually be read out by means of the portable reading unit for inspection or can be reprogrammed. This activity can easily manually be carried out by the operating personnel.

In the control apparatus in accordance with the invention for operating an anode furnace, the anode furnace is formed from a plurality of heating ducts and furnace chambers, wherein the furnace chambers serve for receiving anodes and the heating ducts serve for controlling the temperature of the furnace chambers, wherein the anode furnace comprises at least one furnace unit, wherein the furnace unit comprises a heating zone, a firing zone and a cooling zone, which are in turn formed from at least one section comprising furnace chambers, wherein a suction ramp is arranged in a section of the heating zone and a burner ramp is arranged in a section of the firing zone of the furnace unit, wherein operation of the ramps can be controlled by means of the control apparatus of the furnace unit, wherein the ramps include one reading unit of the control apparatus each, wherein the sections include at least one stationary transponder unit of the control apparatus each, wherein the reading units of the ramps can communicate with the transponder units of the sections in which the ramps are arranged, wherein the control apparatus is embodied in such a manner that the respective transponder units can be identified by means of the control apparatus, and wherein a respective position of the ramps can be determined by allocating the ramps to the respective transponder units.

With respect to the advantages resulting from the control apparatus in accordance with the invention, reference is made to the above description of the method in accordance with the invention.

The control apparatus can include a control unit, wherein the control unit can be a PLC installation. PLC installations can advantageously be utilized for operating anode furnaces and easily be expanded by further functionalities, for example for embodying the method in accordance with the invention.

Advantageously, the transponder unit can be a passive RFID transponder unit. Passive RFID transponder units do not require their own electrical power supply and are thus substantially maintenance-free. The surrounding conditions imposed on an anode furnace, such as heat or pollutions, cannot considerably influence a communication between the transponder unit and the reading instrument.

Advantageously, the transponder unit can have a transponder range of 15 cm to 45 cm. In this way, the reading unit or the reading instrument does not have to be arranged in direct proximity to the transponder unit. In this way, for example between the ramp having the reading unit and the transponder unit, a corresponding distance can be embodied. This is insofar advantageous since the ramp is anyhow only connected to the heating ducts in the area of heating duct openings.

Preferably, the transponder units can be arranged in regular rows in the longitudinal direction of the anode furnace and in uniform positions in the sections. Since the ramps can usually also be displaced in the longitudinal direction of the anode furnace, the reading units of the ramps can always reach an overlapping position with one transponder unit of a row of transponder units in this way. Since the ramps are also always arranged in pre-defined positions in the sections, the transponder units can advantageously be arranged in these exact positions.

However, a position of an antenna of a reading unit at the ramp can be set relative to the position of the transponder unit. In this way, it becomes possible to adjust the reading unit relative to the transponder unit in such a manner that an interference-free communication is ensured. Potential orientation and location tolerance, conditioned by the embodiment of the respective ramp or arrangement of the transponder units, can also easily be compensated for in this way.

Furthermore, every section can include two transponder units which are arranged relative to one ramp position each. If, for example, in a section, a ramp can be mounted in two positions which differ from each other, each of these positions can then be registered or inspected by means of the respective transponder unit. Optionally, a section can also include more than two transponder units, depending on the total number of possible mounting positions.

Advantageously, the transponder unit can be fixedly arranged in an upper mounting base of the anode furnace. In the upper mounting base or in a covering of heating ducts and furnace chambers, a recess can be embodied into which the transponder unit is inserted, such that the transponder unit ends so as to taper with at least an upper side of the base. In the recess, the transponder unit can also be enclosed so as to be covered by a cap or can be enveloped by a sealing compound. In this way, the transponder unit is efficiently protected against detrimental environmental influences and mechanical damage.

Further advantageous embodiments of the control apparatus result from the description of the features of the dependent claims which relate back to the method claim.

BRIEF DESCRIPTION OF THE DRAWING FIGURES

A preferred embodiment of the invention will be explained in greater detail below in reference to the accompanying drawings.

Figure 2:
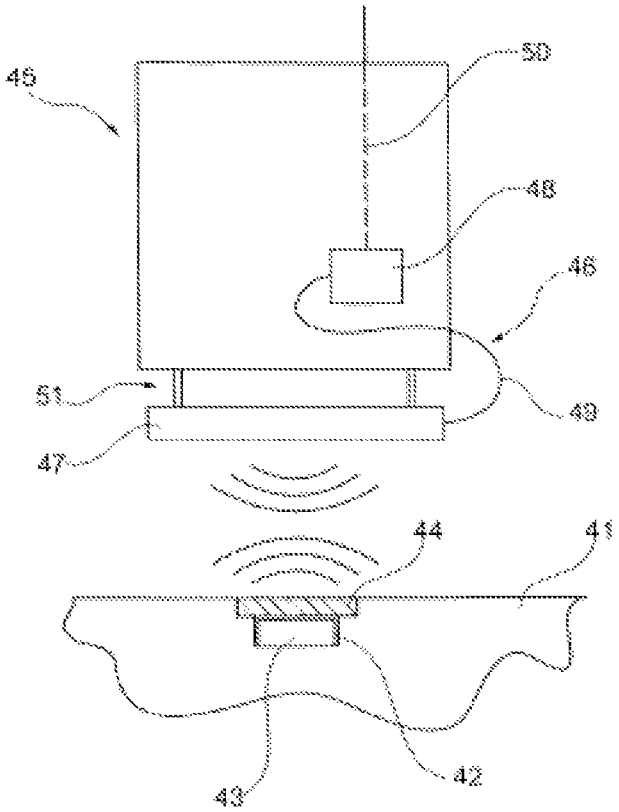
Figure 3:
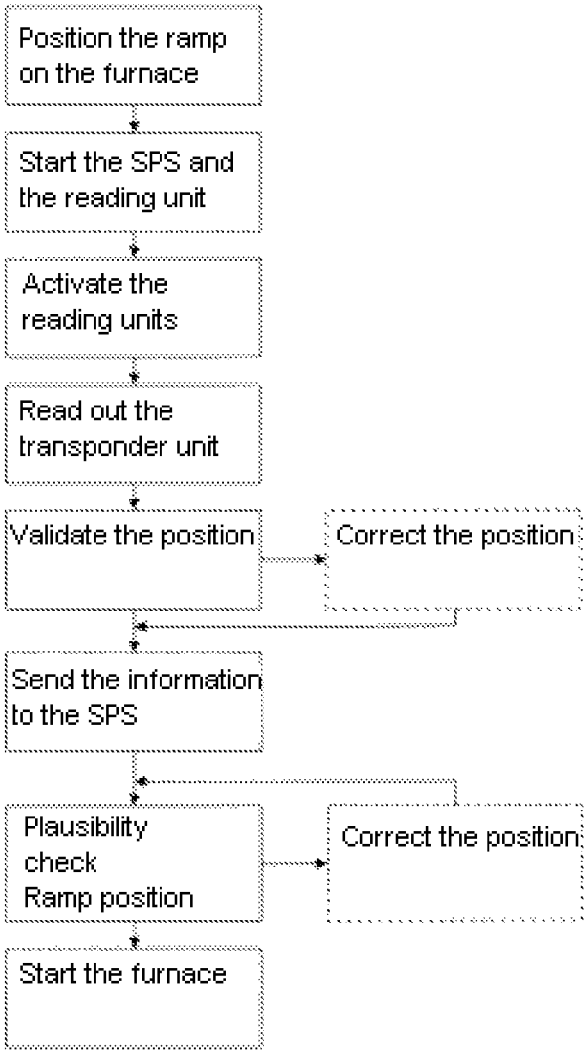

In the figures:

FIG. 1: shows a schematic illustration of a furnace unit of an anode furnace in a longitudinal sectional view;

FIG. 2: shows a partial sectional view of a mounting base of an anode furnace having a ramp;

FIG. 3: shows a flow chart for an embodiment of the method for operating an anode furnace.

DETAILED DESCRIPTION OF THE INVENTION

FIG. 1 shows a schematic illustration of an anode furnace 10 having a furnace unit 11, which furnace is only illustrated in portions here. The anode furnace 10 includes a plurality of heating ducts 12 which run in parallel along furnace chambers that are located inbetween and that are not shown here. In this case, the furnace chambers serve for receiving anodes which are not visibly illustrated here, either. The heating ducts 12, presenting the shape of a meander, run in the longitudinal direction of the anode furnace 10 and include evenly spaced heating duct openings 13, which are respectively covered by a heating duct covering which is not illustrated in greater detail here. The furnace unit 11 furthermore comprises a suction ramp 14, burner ramps 15 and 16, a cooling ramp 17 as well as a zero point ramp 18 and a measuring ramp 19. Their position at the anode furnace 10 is in each case defined, in a manner conditioned by function, by a heating zone 20, a firing zone 21 and a cooling zone 22. Over the course of the production process of the anodes, the furnace unit 11 is displaced relative to the furnace chambers or to the anodes by tramming the ramps 14 to 19 in the longitudinal direction of the anode furnace 10, above the heating ducts 12, such that all anodes that are situated in the anode furnace 10 pass through the zones 20 to 22.

The suction ramp 14 is substantially formed from a collecting duct 23 which is connected to a waste gas cleaning system via an annular duct, which is not illustrated here. The collecting duct 23, in each case via a connecting duct 24, is in turn connected to a heating duct opening 13. A measuring sensor 25 for measuring the temperature in every heating duct 12 is furthermore directly arranged in front of the collecting duct 23, being connected to the same via a data line 26. The measuring ramp 19 is also equipped with measuring sensors 27. The burner ramps 15 and 16 are formed from a plurality of burners 28 and measuring sensors 29 in each case. The zero point ramp 18 also possesses measuring sensors 30, and the cooling ramp 17 is formed from a distributing duct 31 having connecting ducts 32 for the heating duct openings 13.

The ramps 14 to 19 are arranged in sections 33 to 38 in each case, wherein the sections 33 to 38 are in turn formed from heating duct portions 39 in each case. Sections which adjoin the sections 33 to 38 are not illustrated in greater detail here, for the purpose of simplification of the figure. Within the sections 33 to 38 as well as within the sections which are not illustrated here, too, at least one transponder unit each, which unit is not shown here, is arranged in a mounting base 40 of the anode furnace 10.

FIG. 2 shows a partial sectional view of a portion 41 of the mounting base 40 having a recess 42 and a transponder unit 43 which is received in the recess 42. The recess 42 or the transponder unit 43 is provided with a sealing covering 44, such that the transponder unit 43 is protected against environmental influences. Here, the transponder unit 43 marks a mounting position of a ramp 45 which is illustrated in a transverse sectional view here. At the ramp 45, a reading unit 46 is arranged which is formed from an antenna 47 having a reading instrument 48. Via a connection line 49, the reading instrument 48 is connected to the antenna 47 and, via a connection line 50, to a PLC installation, which is not shown here. By means of a mounting device 51, the antenna 47 can be mounted at the ramp 45 in such a manner that it can be directly arranged above the transponder unit 43. In this way, by means of the mounting device 51, imprecisions in the positioning of +/−30 cm in the longitudinal direction and +/−24 cm in the transverse direction relative to an anode furnace can be compensated for.

With the sequence of the method which is illustrated by way of example in FIG. 3, it is now possible to automatically check respective positions of ramps always when putting the furnace unit into operation or when operating the anode furnace of an anode furnace. Referring to the anode furnaces according to FIGS. 1 and 2, the ramps 14 to 19 are initially positioned on the mounting base 40 within the respective sections 33 to 38. When turning on an electricity supply and thus when commencing to put into operation, the PLC installation and the reading instrument are started. The PLC installation activates all reading instruments which read out the transponder units in the area of the ramps 14 to 19 via the antenna. The information which is read out is passed on to the PLC installation and the same checks the information in respect of consistency thereof. If an inconsistency is recognized, a correction, for example of an expected position, can be effected. In this way, it is ensured that the transponder units are situated in the expected positions. In the following, the information is further processed within the PLC installation or is passed on to a further PLC installation, wherein a plausibility check of a position of the ramps 14 to 19 is performed here. This is effected by comparing a determined position to a presupposed position. If one of the ramps 14 to 19 is not situated in the presupposed position, the furnace unit 11 cannot be started. Here, a correction of the respective ramp position or a tramming of the respective ramp 14 to 19 is then required. If no error is recognized during the plausibility check or if the check is successful, initiation of operation of the furnace unit 11 can be completely started, amongst other things, by igniting the burner 28.

The invention claimed is:

1. A method for automatic operating an anode furnace (10), wherein the anode furnace is formed from a plurality of heating ducts (12) and furnace chambers, wherein the furnace chambers serve for receiving anodes and the heating ducts serve for controlling the temperature of the furnace chambers, wherein the anode furnace comprises at least one furnace unit (11), wherein the furnace unit comprises a heating zone (20), a firing zone (21) and a cooling zone (22), which are in turn formed from at least one section (33, 34, 35, 36, 37, 38) comprising furnace chambers, wherein a suction ramp (14) is arranged in a section of the heating zone and a burner ramp (15) of the furnace unit is arranged in a section of the firing zone, wherein ramps are movable and operation of the ramps (14, 15, 16, 17, 18, 19, 45) is controlled by means of a control apparatus of the furnace unit characterized in that the ramps include one reading unit (46) each, wherein the sections include at least one stationary transponder unit (43) each, wherein the reading units of the ramps communicate with the transponder units of the sections in which the ramps are arranged, wherein the respective transponder units are identified by means of the control apparatus, and wherein a respective position of the ramps is determined by allocating the ramps to the respective transponder units.

2. The method according to claim 1, characterized in that upon initiation of operation, a control unit of the control apparatus activates the reading units (46) of the ramps (14, 15, 16, 17, 18, 19, 45), wherein the reading units read out information stored by the transponder units (43) which are allocated to the ramps.

3. The method according to claim 2, characterized in that the information is displayed by the control unit for inspection.

4. The method according to claim 2, characterized in that the information is inspected by the control unit, wherein a plausibility check of position-independent information is effected.

5. The method according to claim 2, characterized in that the information is corrected by the control unit.

6. The method according to claim 2, characterized in that the information is inspected by the control unit, wherein a plausibility check of position-dependent information is effected, wherein a presupposed position of the ramps (14, 15, 16, 17, 18, 19, 45) is compared to an actual position of the ramps.

7. The method according to claim 1, characterized in that initiation of operation of the ramps (14, 15, 16, 17, 18, 19, 45) is only effected after successfully having checked the position of the ramps.

8. The method according to claim 1, characterized in that a numerical designation of the section (33, 34, 35, 36, 37, 38) of the transponder unit, a numerical designation of the anode furnace (10) of the transponder unit and a total number of the sections (33, 34, 35, 36, 37, 38) of the anode furnace of the transponder unit are stored by the transponder unit (43).

9. The method according to claim 1, characterized in that the transponder unit (43) is programmed by a portable reading instrument.

10. An automatic control apparatus for operating an anode furnace (10), wherein the anode furnace is formed from a plurality of heating ducts (12) and furnace chambers, wherein the furnace chambers serve for receiving anodes and the heating ducts serve for controlling the temperature of the furnace chambers, wherein the anode furnace comprises at least one furnace unit (11), wherein the furnace unit comprises a heating zone (20), a firing zone (21) and a cooling zone (22), which are in turn formed from at least one section (33, 34, 35, 36, 37, 38) comprising furnace chambers, wherein a suction ramp (14) is arranged in a section of the heating zone and a burner ramp (15) of the furnace unit is arranged in a section of the firing zone, wherein ramps are movable and operation of the ramps (14, 15, 16, 17, 18, 19, 45) is controlled by means of the control apparatus of the furnace unit, characterized in that the ramps include one reading unit (46) of the control apparatus each, wherein the sections include at least one stationary transponder unit (43) of the control apparatus each, wherein the reading units of the ramps can communicate with the transponder units of the sections in which the ramps are arranged, wherein the control apparatus is embodied in such a way that the respective transponder units can be identified by means of the control apparatus, and wherein a respective position of the ramps can be determined by allocating the ramps to the respective transponder units.

11. The control apparatus according to claim 10, characterized in that the control apparatus includes a control unit, wherein the control unit is a PLC installation.

12. The control apparatus according to claim 10, characterized in that the transponder unit (43) is a passive RFID transponder unit.

13. The control apparatus according to claim 10, characterized in that the transponder unit (43) has a transponder range of 15 cm to 45 cm.

14. The control apparatus according to claim 10, characterized in that the transponder units (43) are arranged in regular rows in the longitudinal direction of the anode furnace (10) and in common positions in the sections (33, 34, 35, 36, 37, 38).

15. The control apparatus according to claim 10, characterized in that a position of an antenna (47) of the reading unit (46) at the ramp (14, 15, 16, 17, 18, 19, 45) can be set relative to the position of the transponder unit (43).

16. The control apparatus according claim 10, characterized in that every section (33, 34, 35, 36, 37, 38) includes two transponder units (43) which are arranged relative to one possible ramp position each.

17. The control apparatus according to claim 10, characterized in that the transponder unit (43) is fixedly arranged in an upper assembly floor (40, 41) of the anode furnace (10).

* * * * *